US005250922A

United States Patent [19]

Forsberg et al.

[11] Patent Number: 5,250,922

[45] Date of Patent: Oct. 5, 1993

[54] TRANSFORMER OR REACTOR COOLED BY AN INSULATING AGENT

[75] Inventors: Erik Forsberg, Smedjebacken; Sören Petersson, Ludvika, both of Sweden

[73] Assignee: ASEA Brown Boveri AB, Västerås, Sweden

[21] Appl. No.: 963,738

[22] Filed: Oct. 20, 1992

[30] Foreign Application Priority Data

Oct. 23, 1991 [SE] Sweden ..... 9103087

[51] Int. Cl.[5] ..... H01F 27/08

[52] U.S. Cl. ..... 336/60

[58] Field of Search ..... 336/55, 57, 58, 60, 336/61; 310/65

[56] References Cited

U.S. PATENT DOCUMENTS 4,039,990 8/1977 Philp ..... 336/60

*Primary Examiner*—Thomas J. Kozma

*Attorney, Agent, or Firm*—Watson, Cole, Grindle & Watson

[57] ABSTRACT

A transformer or reactor with a winding of a sheet-formed conductor material wherein the winding comprises a cooling element arranged between two consecutive winding turns and wherein the conductor material, within a region nearest the cooling element, in the axial direction of the winding has a decreasing width for each winding turn towards both the inner and outer cylindrical surfaces of the cooling element.

5 Claims, 1 Drawing Sheet

TRANSFORMER OR REACTOR COOLED BY AN INSULATING AGENT

TECHNICAL FIELD

The present invention relates to a sheet-wound transformer or reactor cooled by an insulating agent. The transformer or reactor comprises a core of magnetic material with at least one leg and one yoke, at least one winding arranged substantially concentrically around the core leg and built up of several turns of a conductor sheet wound one above the other, the conductor sheet being composed of a metal foil and an insulating film arranged at least one one side. The transformer or reactor further comprises at least one cooling element arranged between two consecutive winding turns.

BACKGROUND ART, THE PROBLEMS

In transformers and reactors with sheet-wound or foil-wound windings, problems may arise due to different electric powers towards the edges of the sheet. One such problem is that a heavy displacement of current may arise, which results in heavy additional losses as well as in powerful localized heating of the sheet edges. The current displacement is caused by the fact that the substantially axial magnetic leakage flux extending between the windings is deflected in a more or less radial direction at the ends of the windings, instead of continuing axially and passing into the yokes. This causes the ends of the windings to be traversed by a magnetic flux with a radial component which generates eddy currents in the winding conductor and causes losses in addition to the unavoidable ohmic losses caused by the conductor current. To reduce these problems, several solutions have been proposed, one of which is described in SE 418 234. Here a method is described which is characterized in that the conductor sheet at its end portions, at least in a region at the periphery of the winding, follows a funnel-shaped double-curved surface. Another method is described in SE 428 979, which is characterized in that the cooling channels include spacers which exhibit an increasing thickness towards the end surfaces of the winding.

The double curvature which is needed to reduce the effect of the current displacement is necessary above all in those parts of the sheet winding which, viewed in a radial direction, are furthest away from the axial centre line of the winding. For practical reasons, sheet windings are therefore sometimes formed with an end surface in a plane perpendicular to the centre line for that part which, viewed in a radial direction, lies nearest the axial centre line of the winding. These parts will be referred to below as the central and peripheral parts of the sheet winding, respectively.

Another known electrical phenomenon is that high electric field intensities arise at sharp edges or pointed projections, and these field intensities may cause corona and electric flashover. Reducing these field intensity concentrations by increasing the radius of curvature of the edges or projections in different ways belongs to the state of the art.

In existing sheet winding designs, a potentially dangerous region, with respect to corona and possibly electric flashover, exists in those parts of a sheet winding which adjoin both sides of a cooling channel. This is true both for those parts of the sheet winding which comprise the central and the peripheral parts. The reason is that for the central parts of the sheet winding, the end surface of the sheet winding forms a right angle with the internal and external walls of the cooling channels, that is, the sheet winding forms a right-angled edge. For the peripheral parts of the sheet winding the risk of corona and discharge will be even greater since the end surface of the sheet winding forms an angle with the cylindrical surfaces of the cooling channels, especially with the internal cylindrical surfaces, which is smaller than a right angle, that is, the sheet winding forms an even more acute angle with the cooling channels. This is shown very clearly in the accompanying drawings.

SUMMARY OF THE INVENTION, EMBODIMENTS

Figure 1:
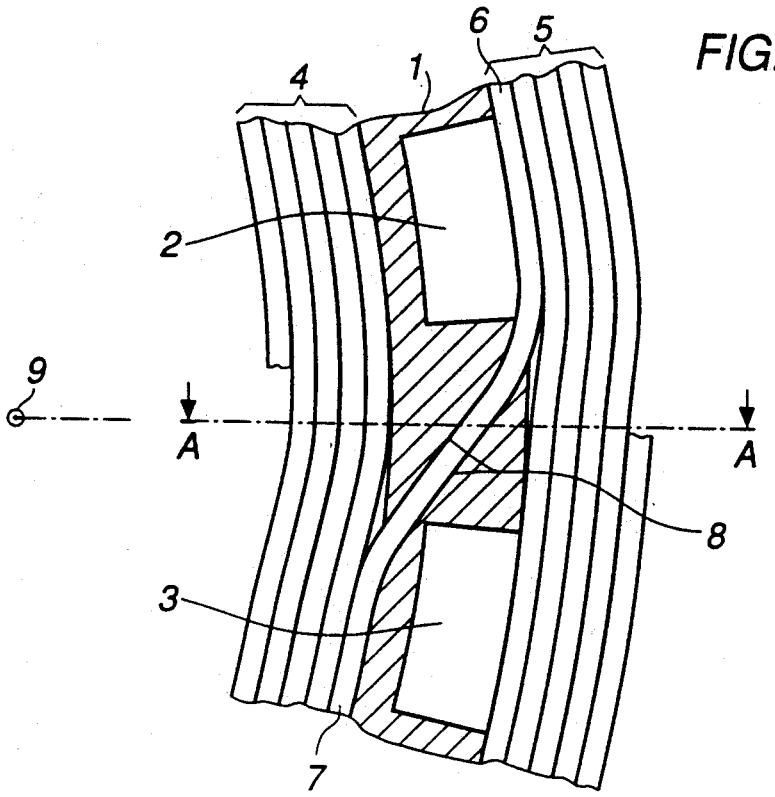
FIG. 1 shows a section of a sheet winding seen in a direction parallel to the axial centre line of the winding.

FIG. 1 shows, viewed in a plane perpendicular to the axial centre line of the winding, those parts of a sheet winding which adjoin a cooling element 1. The cooling element consists of a curved insulating plate, often called cooling mat, from which slots 2, 3 etc. are sawed or milled out around the whole winding and through which the cooling agent may pass. The figure also shows some of the sheet layers 4 and 5 positioned inside and outside the cooling element. To transfer the sheet layer 6 lying immediately inside the cooling element to the sheet layer 7 lying immediately outside the cooling element, the cooling mat is provided with a bevelled opening 8. The axial centre line of the sheet winding is indicated at 9.

Figure 2:
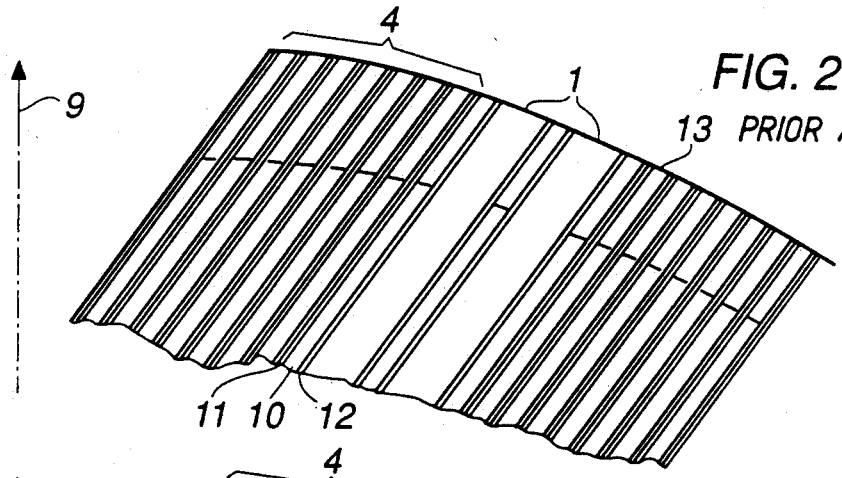
FIG. 2 PRIOR ART
FIG. 2 shows a section at the peripheral part of a sheet winding, perpendicular to the section in FIG. 1. The figure shows how the metal foil, the insulating tape, etc., are formed around a cooling channel according to the state of the art.

The state of the art as regards the design of the sheet winding on both sides of a cooling channel is shown in more detail in FIG. 2, which shows parts of a plane A—A through the axial centre line 9 of the sheet winding. The figure shows how each sheet layer consists of a metal foil 10 which, in the example shown, is surrounded on both sides by insulating foils 11 and 12. Since the axial length of the metal foil is shorter than the axial length of the coil, an edge strip 13 is introduced between the insulating foils, at the two ends of the sheet winding. As is clear from the figure, the end surface of the sheet winding will therefore, at the peripheral part of the winding, form an acute angle smaller than a right angle with the cylindrical surfaces of the cooling elements. At the continuous transition towards the central part of the winding, the angle of the pointed edge, that is, the angle between the plane of the end surface and the cylindrical end surfaces of the cooling elements, will approach a right angle. Concurrently with increased voltages on transformers and reactors, the risk of corona and flashover will then increase, especially at the double-curved part of the winding.

Figure 3:
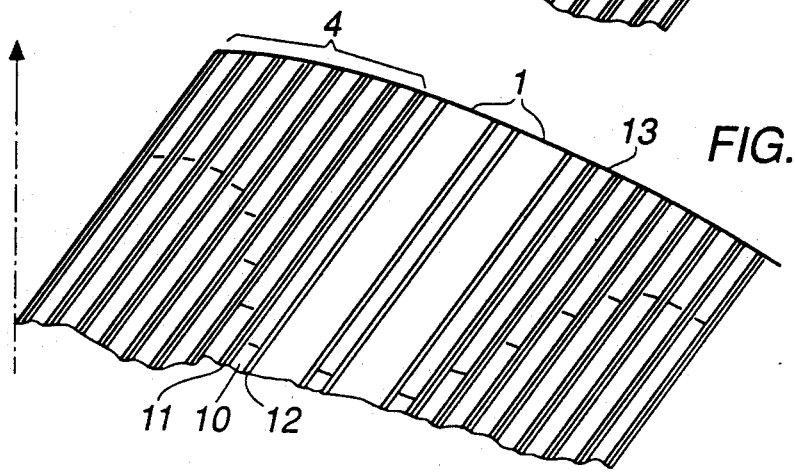
FIG. 3 shows the same section as FIG. 2, but with a design according to the invention.

The invention is clear from FIG. 3, which shows the same sectional view as FIG. 2. To avoid the high field intensities which arise at the above-mentioned acute and right angles, a reduction of the width of the metal foil takes place in the axial direction towards both the internal and external cylindrical surfaces of the cooling element. This will cause the edge of the sheet winding with its electrical potential towards the cooling element to become bevelled to an extent corresponding to a considerably greater radius of curvature, whereby the risks of corona and flashover can be considerably reduced. To maintain the axial length of the sheet winding at the cooling element, the axial width of the edge strip is at the same time extended to an extent corresponding to the decrease of the foil length.

The bevelling can be performed in a plurality of different ways, and the envelope to the bevelled metal foil layers may have a varying, curve shape. To avoid discontinuities in the envelope, there should be a near tangential connection both to the end surface of the metal foil winding and to the cylindrical surfaces of the cooling element. To obtain a symmetrical field voltage distribution towards the pointed edge, the bevelling should, in addition, be mirror-symmetrical around the bisector of the angle. In a preferred embodiment, the envelope consists of an arc with its centre on the bisector. In this case, it is then completely correct to talk about the radius of curvature of the envelope. The magnitude of the radius of curvature in a concrete case is determined by many factors, such as the voltage level, the value of the angle, safety margins, etc. However, the envelope need not be formed as an arc to attain satisfactory and sufficient safety against corona and flashover, nor need it be symmetrically formed around the bisector. It may, for example, be formed as parts of a parabola, an ellipse or a hyperbola or change from one curve shape to another. For practical reasons, the connection to the cooling element may, for example, take place in the form of a straight curve. It should be pointed out here that no significant increase of the electric field voltage arises if the connection is slightly discontinuous instead of tangential.

Independently of the curve shape of the envelope, however, it is practical, both for designing and quantifying the curve, to define it with the aid of a "radius of curvature", which must not be smaller than a certain given measure. As indicated above, the currently permissible smallest radius of curvature depends on several factors, such as the voltage level, the value of the angle, safety margins etc. As a realistic value of the radius of curvature for transformers and reactors, it can be said that it should not be below 1 mm.

We claim:

1. A transformer or reactor comprising a core of magnetic material with at least one leg and one yoke and at least one winding (4, 5) of sheet-formed conductor material (10) in the form of metal foil arranged substantially concentrically around the leg, at least cn one side of the conductor sheet there being arranged an insulating film (11, 12) which has a width in the axial direction of the winding which is greater than the width of the conductor sheet, at the edges of the winding and in the axial extension of the conductor sheet there being arranged edge strip which has an axial width corresponding to the difference between the width of the conductor sheet and the width of the insulating film, the winding comprising at least one cooling element (1) arranged between two consecutive winding turns, characterized in that the axial length of the metal foil within a region nearest the at least one cooling element decreases for each winding turn towards both inner and outer cylindrical surfaces of the at least one cooling element.

2. A transformer or reactor according to claim 1, characterized in that the axial length of the metal foil within a region nearest the at least one cooling element decreases for each winding turn towards both the inner and outer cylindrical surfaces of the at least one cooling element in such a way that a curve interconnecting the edges of the metal foil is defined with the aid of a radius of curvature.

3. A transformer or reactor according to claim 1, characterized in that the axial length of the metal foil within a region nearest the at least one cooling element decreases for each winding turn towards both the inner and outer cylindrical surfaces of the at least one cooling element in such a way that a curve interconnecting the edges of the metal foil has a radius of curvature which is equal to or greater than 1 mm.

4. A transformer or reactor according to claim 1, characterized in that the axial length of the metal foil within a region nearest the at least one cooling element decreases for each winding turn towards both the inner and outer cylindrical surfaces of the at least one cooling element in such a way that a curve interconnecting the edges of the metal foil tangentially adjoins both the end surface of the metal foil winding and the inner and outer cylindrical surfaces of the at least one cooling element.

5. A transformer or reactor according to claim 1, characterized in that the axial length of the metal foil within a region nearest the at least one cooling element decreases for each winding turn towards both the inner and outer cylindrical surfaces of the at least one cooling element in such a way that a curve interconnecting the edges of the metal foil constitutes a circular arc.

* * * * *